US005830004A

United States Patent [19]

Abe

[11] Patent Number: 5,830,004

[45] Date of Patent: Nov. 3, 1998

[54] PRESS-CONNECTING TERMINAL

[75] Inventor: Kimihiro Abe, Shizuoka, Japan

[73] Assignee: Yazaki Corporation, Tokyo, Japan

[21] Appl. No.: 906,896

[22] Filed: Aug. 6, 1997

[30] Foreign Application Priority Data

Aug. 6, 1996 [JP] Japan ..... 8-207217

[51] Int. Cl.[6] ..... H01R 11/20

[52] U.S. Cl. ..... 439/398; 439/397

[58] Field of Search ..... 439/397, 398, 439/395, 399

[56] References Cited

FOREIGN PATENT DOCUMENTS 60-68568 4/1985 Japan ..... H01R 4/24

5-45906 6/1993 Japan ..... H01R 4/24

*Primary Examiner*—Neil Abrams

*Assistant Examiner*—Antoine Ngandjui

*Attorney, Agent, or Firm*—Sughrue, Mion, Zinn, Macpeak & Seas, PLLC

[57] ABSTRACT

A press-connecting terminal including a contact portion provided on one side of a bottom wall so as to be connected to a partner terminal, a caulking portion provided on the other side of the bottom wall for caulking an electric wire, and a press-connecting portion provided between the contact portion and the caulking portion so that an end of the electric wire is press-connected to the press-connecting portion. The press-connecting portion is formed into a frame constituted by a pair of press-connecting blades and a pair of side walls for connecting respective ends of the press-connecting blades to each other through the side walls, each of the press-connecting blades being constituted by an inner press-connecting blade portion and an outer press-connecting blade portion which are put on top of each other, one of the side walls being constituted by a single continuous wall portion, the other of the side walls being constituted by a plurality of wall portions engaged with each other at an intermediate portion of the other side wall to thereby improve the strength of the press-connecting portion.

3 Claims, 3 Drawing Sheets

PRESS-CONNECTING TERMINAL

BACKGROUND OF THE INVENTION

1. Field of the Invention

The present invention generally relates to a press-connecting terminal, and particularly relates to a press-connecting terminal used for connecting an electric wire by means of press-connecting blades contacting with the electric wire in a state where the electric wire is coated.

2. Description of the Related Art

It is necessary for a press-connecting terminal to have enough strength to endure pressure because an electric wire is pressed thereon, and it is necessary that the gap of the press-connecting blade to which the electric wire is press-connected is prevented from being spread. FIGS. 3 and 4 show conventional press-connecting terminals disclosed in Japanese Patent Unexamined Publication No. Sho. 60-68568 and Japanese Utility Model Unexamined Publication No. Hei. 5-45906, respectively.

The press-connecting terminal in FIG. 3 is formed into the illustrated shape through press-punching and press-bending of an original sheet consisting of a single electrically conductive plate. The press-connecting terminal is constituted by a female terminal portion 1, a press-connecting portion 2 which is electrically connected to an electric wire when the latter is forced to the former, and a bottom wall 3 which connects the female terminal portion 1 and the press-connecting portion 2 to each other. The press-connecting portion 2 is formed by bending the original sheet into a squarish inverted-U shape so that the press-connecting portion 2 is constituted by a pair of standing walls 4 standing up from the bottom wall 3, and press-connecting blades 5 formed in the facing surfaces of the standing walls 4. When an electric wire is forced into between the press-connecting blades 5, the press-connecting blades 5 bite the coating of the electric wire so as to electrically contact with an inner conductor.

In the press-connecting terminal in FIG. 4, a pair of parallel side walls 7 are provided so as to extend from a contact portion 6 which will be connected to a partner terminal. A press-connecting blade member 8 having a pair of press-connecting blades 9 is locked on these side walls 7 so as to be attached thereto. That is, this press-connecting terminal is manufactured by assembling two members.

However, since the bottom surfaces of the standing walls 4 are not continuous in the press-connecting terminal in FIG. 3, there is a problem that a discontinuous portion 4*a* of the bottom surfaces is apt to be elongated in the axial direction when an axially pulling force acts on an electric wire after the electric wire is press-connected so that the press-connecting blades 5 are elongated in the axial direction.

On the other hand, since the press-connecting blade member 8 is locked on the side walls 7 in the press-connecting terminal in FIG. 4, it is indeed possible to prevent the press-connecting blades 9 from being elongated, but the beam width becomes so narrow that the total strength is reduced. In addition, since the press-connecting terminal is manufactured by assembling the two members, it is necessary to carry out a step of forming the respective members separately and a step of assembling the thus formed two members, so that the manufacturing process is complicated, and it takes a long time to manufacture the press-connecting terminal. Further, it is necessary to prepare an assembling machine as well as finishing machines for the individual members, so that the manufacturing equipment as a whole becomes large.

SUMMARY OF THE INVENTION

It is therefore an object of the present invention to solve the foregoing problems.

It is another object of the present invention to provide a press-connecting terminal which has enough strength and rigidity so that press-connecting blades are not elongated, and which can be constituted by a single member so as to be manufactured easily.

In order to attain the foregoing objects, according to the invention, there is provided a press-connecting terminal comprising: a bottom wall; a contact portion provided on one side of the bottom wall so as to be connected to a partner terminal; and a press-connecting portion provided on the other side of the bottom wall so that an end of an electric wire is press-connected to the press-connecting portion, the press-connecting portion being formed into a frame comprising a pair of press-connecting blades and a pair of side walls for connecting respective ends of the press-connecting blades to each other through the side walls, each of the press-connecting blades being constituted by an inner press-connecting blade portion and an outer press-connecting blade portion which are put on top of each other, one of the side walls being constituted by a single continuous wall portion, and the other of the side walls being constituted by a plurality of wall portions engaged with each other at an intermediate portion of the other side wall.

DETAILED DESCRIPTION OF THE PREFERRED EMBODIMENT

Figure 1:
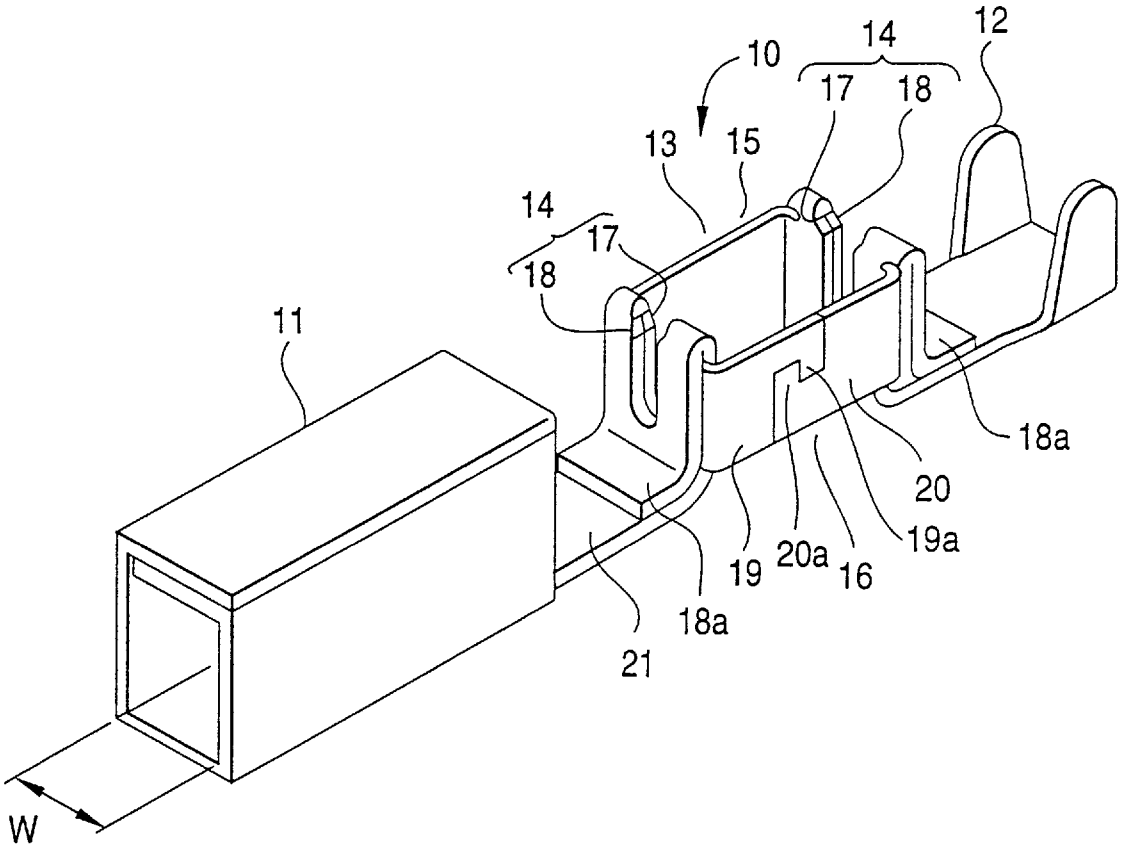
FIG. 1 is a perspective view of a press-connecting terminal according to an embodiment of the present invention.
Figure 2:
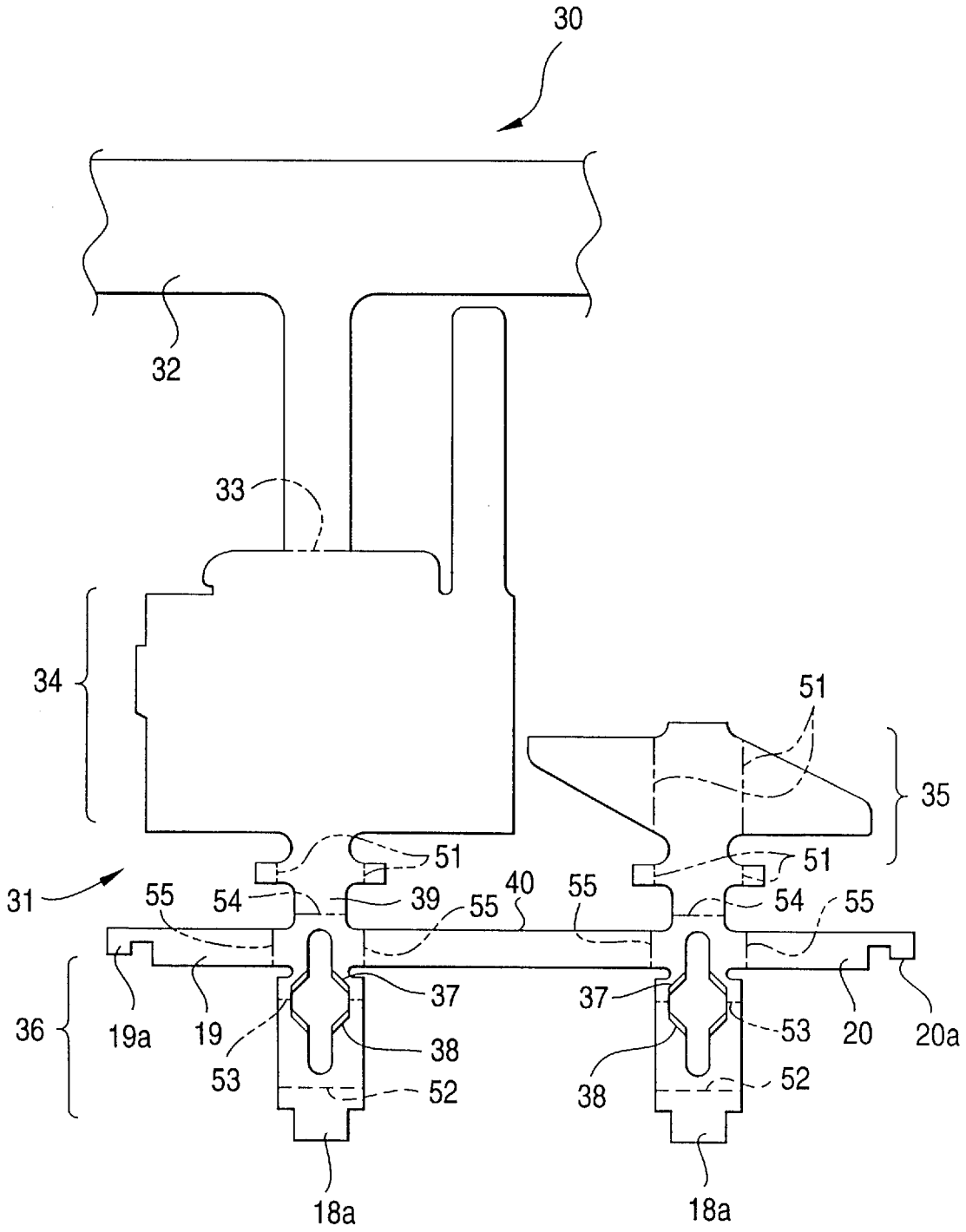
FIG. 2 is an enlarged plan view of the press-connecting terminal.
Figure 3:
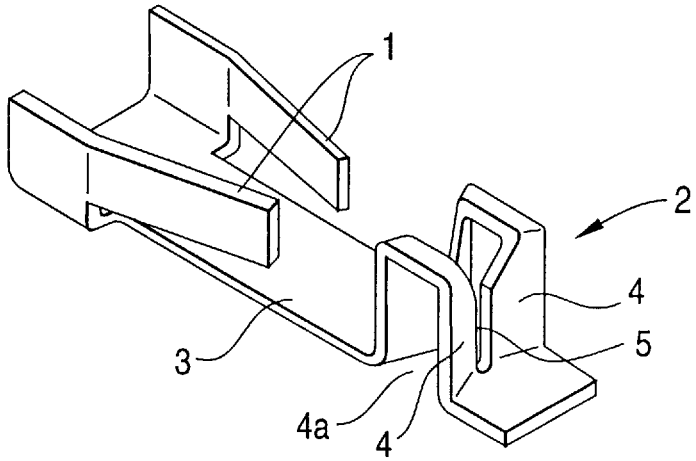
FIG. 3 PRIOR ART
FIG. 3 is a perspective view of a conventional press-connecting terminal.
Figure 4:
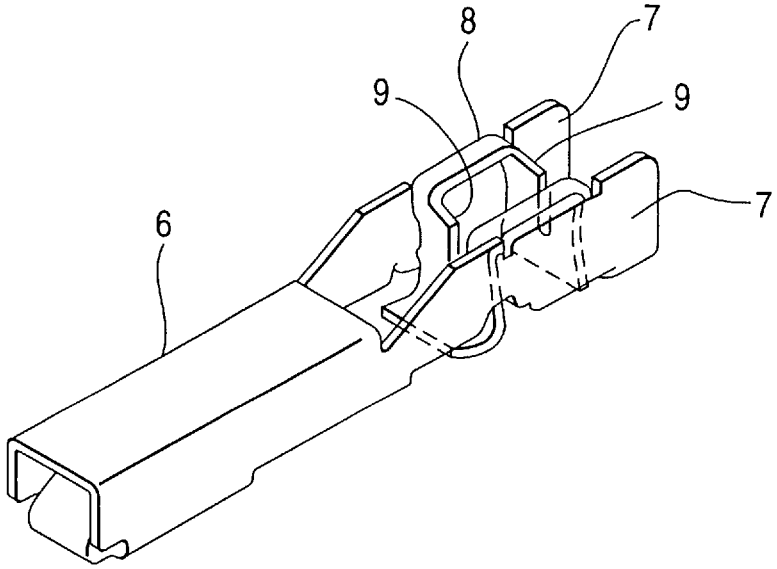
FIG. 4 PRIOR ART
FIG. 4 is a perspective view of another conventional press-connecting terminal.

FIG. 1 is a perspective view of a press-connecting terminal according to an embodiment of the present invention, and FIG. 2 is an enlarged plan view of the press-connecting terminal before bending work. A press-connecting terminal 10 has a contact portion 11 on one side, a caulking portion 12 on the other side, a press-connecting portion 13 disposed between the contact portion 11 and the caulking portion 12, and a bottom wall 21 which couples these portions 11, 12 and 13 with each other, as shown in FIG. 1. This press-connecting terminal 10 is formed by bending a chained terminal (see FIG. 2) formed from electrically conductive metal, as will be described later.

The contact portion 11 is shaped into a square tube opened in its longitudinal or front/rear direction. When a partner terminal (not shown) is inserted to the opening portion on the forward end side, the partner terminal contacts with the contact portion 11 so that the press-connecting terminal 10 is brought into contact with the partner terminal.

The bottom wall 21 is bent at an end portion on the side opposite to the contact portion 11 so that the bottom wall 14 stands up to thereby form the caulking portion 12 having lips. A coated electric wire (not shown) is fitted into the caulking portion 12 with its coating left as it is, and the lips of the caulking portion 12 are caulked so that the coating of the electric wire is fixedly held by the caulking portion 12 from its opposite sides.

The press-connecting portion 13 is disposed perpendicularly to the longitudinal direction of the press-connecting terminal 10. The press-connecting portion 13 has a pair of press-connecting blades 14 and 14 disposed on the contact portion 11 side and on the caulking portion 12 side, and side walls 15 and 16 coupling these press-connecting blades 14 and 14 with each other, so that the whole is formed into a frame.

Each of the pair of press-connecting blades 14 is constituted by an inner press-connecting blade portion 17 and an outer press-connecting blade portion 18 which are put on top of each other so that the rigidity is increased. It is therefore possible to ensure enough contact load with an electric wire. The opposite end portions of each of the side walls 15 and 16 are bent. These bent end portions are held between the inner press-connecting blade portion 17 and the outer press-connecting blade portion 18 so that the press-connecting blades 14 are coupled with the side walls 15 and 16 respectively.

In addition, the lower portions of the respective outer press-connecting blade portions 18 are bent to extend to the contact portion 11 and the caulking portion 12, and these bent portions 18*a* are put on the bottom wall 21. This superimposition increases the supporting force of the outer press-connecting blade portions 18. Accordingly, the total rigidity of the press-connecting blades 14 and 14 increases more, so that it is possible to prevent the gap of the press-connecting blades 14 from being spread by the press-connection of an electric wire.

Of the pair of side walls, one side wall 15 is a continuous wall portion. That is, this side wall 15 is constituted by a single plate.

The other side wall 16 is constituted by two wall portions 19 and 20 which are engaged with each other. That is, this side wall 16 may be constituted by a plurality of wall portions which are engaged with each other in the intermediate portion, so as to be like a single plate because of the engagement. The reference numerals 19*a* and 20*a* represent engagement portions where these wall portions 19 and 20 are engaged with each other. These wall portions 19 and 20 are not of different original sheets, but of different portions of a single original sheet.

Since the press-connecting portion 13 arranged thus is shaped into a frame constituted by the pair of press-connecting blades 14 and 14 and the side walls 15 and 16 coupling these press-connecting blades, the mechanical strength is increased. In addition, each of the press-connecting blades 14 has a double-layer structure, so that the rigidity is also increased. Therefore, there is no fear that the gap of the press-connecting blade 14 is spread even if an electric wire is pressed thereto, and there is no case that the press-connecting blade 14 is extended in the direction of a pulling force even if the pulling force acts on the press-connecting electric wire. Accordingly, it is possible to keep enough contact load, and it is possible to ensure a reliable connection state for a long term.

FIG. 2 shows a chained terminal 30 for manufacturing the press-connecting terminal 10. In FIG. 2, a number of original sheets 31 are disposed at predetermined intervals on a long guide plate 32. In this state, the terminal 30 is introduced into a pressing machine and bent plural times to form the press-connecting terminals 10, and thereafter each press-connecting terminal 10 is separated from the guide plate 32 with a cutting line 33 as a border.

In the original sheet 31 in FIG. 2, the reference numeral 34 designates a contact-portion forming portion for forming the contact portion 11 of the press-connecting terminal 10; 35, a caulking-portion forming portion for forming the caulking portion 12; and 36, a press-connecting portion forming portion for forming the press-connecting portion 13. In addition, 37 designates an inner press-connecting-blade-portion forming portion for forming the inner press-connecting blade portion 17; 38, an outer press-connecting-blade-portion forming portion for forming the outer press-connecting blade portion 18; and 39, a bottom-wall forming portion for forming the bottom wall 21.

The reference numeral 40 designates a side-wall forming portion for forming one side wall 15 consisting of a continuous wall portion. On the other hand, the wall portions 19 and 20 for forming the other side wall 16 are disposed further outside the inner press-connecting-blade-portion forming portions 37 on the opposite sides of this side-wall forming portion 40, and the wall portions 19 and 20 have engagement portions 19*a* and 20*a* on their end portions respectively. A bent portion 18*a* to be put on the bottom wall 21 is formed on an end portion of the outer press-connecting-blade-portion forming portion 38.

In FIG. 2, bending lines 52 and 55 illustrated by the broken lines are portions to be bent like a mountain, while bending lines 51, 53 and 54 illustrated by the alternate long and short dash lines are portions to be bent like a valley.

This original sheet 31 is bent like a valley along the bending line 51, and thereafter bent like a mountain along the bending line 52. After that, the original sheet 31 is bent like a valley along the bending line 53 so that the inner press-connecting-blade-portion forming portion 37 and the outer press-connecting-blade-portion forming portion 38 are put on top of each other to thereby form the press-connecting blade 14 in which the inner press-connecting blade portion 17 and the outer press-connecting blade portion 18 are put on top of each other.

After that, valley-like bending is performed along the bending line 54, and mountain-like bending is performed along the bending line 55 so that the original sheet 31 is formed into a frame, and the engagement portions 19*a* and 20*a* are positioned to be engaged with each other. The bent portion 18*a* is put on the bottom wall 21, and the forward end of the bending line 51 is bent to fix the bent portion 18*a*. Accordingly, it is possible to form the press-connecting portion 13 like such a frame as shown in FIG. 1.

In the above embodiment, if the width of the outer press-connecting blade portion 18 is set to be equal to the width (W) of the bottom wall 21 (see FIG. 1), it is possible to increase the strength of the outer press-connecting blade portion 18. In this case, the inner press-connecting blade portion 17 and the pair of side walls 15 and 16 can be formed by bending the original sheet in which the press-connecting blade portion 17 and the side walls 15 and 16 are connected to each other as shown in FIG. 2, and at the same time, the formation is made easy because the pair of side walls 15 and 16 are bent with smaller width than that of the bottom wall 21.

According to the present invention, the inner press-connecting blade portion and the outer press-connecting blade portion are put on top of each other to form the press-connecting blade. Accordingly, the total rigidity of the press-connecting blade increases. It is therefore possible to obtain enough contact load with an electric wire, so that reliable conductivity can be realized.

In addition, the pair of press-connecting blades are connected to each other through the pair of side walls so as to form a frame in which the press-connecting blades and the side walls are coupled with each other. In addition, each of the side walls is shaped into a continuous plate or made continuous through the engagement of the intermediate portion. As a result, the total strength of the press-connecting portion increases. It is therefore possible to ensure press-connection with a superior contact load without elongating the press-connecting blades in the pulling direction even if a pulling force of a press-connected electric wire acts thereon.

Further, being manufactured not by assembling two members but by bending a single original sheet, the press-connecting terminal can be manufactured easily.

What is claimed is:

1. A press-connecting terminal comprising:

a bottom wall;

a contact portion provided on one side of said bottom wall so as to be connected to a partner terminal; and a press-connecting portion provided on the other side of said bottom wall so that an end of an electric wire is press-connected to said press-connecting portion, said press-connecting portion being formed into a frame comprising a pair of press-connecting blades and a pair of side walls for connecting respective ends of said press-connecting blades to each other through said side walls, each of said press-connecting blades being constituted by an inner press-connecting blade portion and an outer press-connecting blade portion which are put on top of each other, one of said side walls being constituted by a single continuous wall portion, and the other of said side walls being constituted by a plurality of wall portions engaged with each other at an intermediate portion of said other side wall.

2. The press-connecting terminal according to claim 1, wherein lower portions of said outer press-connecting blade portions of said press-connecting blades are elongated toward a side of said contact portion and toward the opposite side thereto respectively so as to be put on said bottom wall.

3. The press-connecting terminal according to claim 1, wherein a width of each of said outer press-connecting blade portions of said press-connecting blades is made equal to a width of said bottom wall, wherein said inner press-connecting blade portions of said press-connecting blades and said pair of side walls are formed by bending a single sheet in a state in which said inner press-connecting blade portions and said pair of side walls are connected to each other, and wherein said pair of side walls are bent with a width smaller than the width of said bottom wall.

* * * * *